US011802530B2

(12) United States Patent
Han

(10) Patent No.: US 11,802,530 B2
(45) Date of Patent: Oct. 31, 2023

(54) METHOD OF REMOVING PARTICLES IN AN INJECTOR OF A DIESEL ENGINE, APPARATUS FOR PERFORMING THE SAME AND DIESEL ENGINE INCLUDING THE APPARATUS

(71) Applicant: HYUNDAI DOOSAN INFRACORE CO., LTD., Incheon (KR)

(72) Inventor: Hyoungmin Han, Seoul (KR)

(73) Assignee: HYUNDAI DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 17/584,907

(22) Filed: Jan. 26, 2022

(65) Prior Publication Data

US 2022/0252031 A1 Aug. 11, 2022

(30) Foreign Application Priority Data

Feb. 9, 2021 (KR) ..... 10-2021-0018095

(51) Int. Cl.

| | |
|---|---|
| ***F02M 51/00*** | (2006.01) |
| ***F02M 65/00*** | (2006.01) |
| ***F02D 41/04*** | (2006.01) |
| ***F02D 41/36*** | (2006.01) |

(52) U.S. Cl.

CPC ..... *F02M 65/008* (2013.01); *F02D 41/042* (2013.01); *F02D 41/36* (2013.01)

(58) Field of Classification Search

CPC ..... F02M 65/008; F02M 2200/07; F02D 41/042; F02D 41/36; F02D 2041/224; F02D 41/221; F02D 41/38

USPC ..... 123/478

See application file for complete search history.

(56) References Cited

U.S. PATENT DOCUMENTS 4,741,478 A * 5/1988 Teerman ..... F02M 61/205 239/126
4,777,921 A * 10/1988 Miyaki ..... F02M 63/0225 123/456
5,265,804 A * 11/1993 Brunel ..... F02M 59/466 239/125

(Continued)

FOREIGN PATENT DOCUMENTS

DE 10 2010 027 986 A1 10/2011
DE 10 2013 002 758 A1 8/2014
FR 3 083 268 A1 1/2020

(Continued)

OTHER PUBLICATIONS

Extended European Search Report dated Jun. 17, 2022, for corresponding European Patent Application No. 22154416.6.

(Continued)

*Primary Examiner* — Hung Q Nguyen
*Assistant Examiner* — Anthony Donald Taylor, Jr.
(74) *Attorney, Agent, or Firm* — Hauptman Ham, LLP

(57) ABSTRACT

In a method of removing particles in an injector of a diesel engine, a stop of the diesel engine may be recognized. An injection signal may be inputted into the injector of the stopped diesel engine. A control valve of the injector may be moved in a low-pressure passage by the injection signal to remove the particles accumulated on an inner wall of the low-pressure passage. Thus, a malfunction of the control valve caused by the particles may be previously prevented.

11 Claims, 3 Drawing Sheets

(56) References Cited

U.S. PATENT DOCUMENTS 6,647,769 B1 11/2003 Fujino et al.

FOREIGN PATENT DOCUMENTS

| | | | | | |
|---|---|---|---|---|---|
| FR | 3083268 | A1 * | 1/2020 | ..... | F02D 41/042 |
| FR | 3083268 | A1 * | 1/2020 | ..... | F04D 41/042 |
| JP | 2015075069 | A * | 4/2015 | | |

OTHER PUBLICATIONS

Chinese Office Action dated Apr. 11, 2023, in connection with the Chinese Patent Application No. 202210118648.3, 11 pages, partial translation.

* cited by examiner

METHOD OF REMOVING PARTICLES IN AN INJECTOR OF A DIESEL ENGINE, APPARATUS FOR PERFORMING THE SAME AND DIESEL ENGINE INCLUDING THE APPARATUS

CROSS-RELATED APPLICATION

This application claims priority under 35 USC § 119 to Korean Patent Application No. 10-2021-0018095, filed on Feb. 9, 2021 in the Korean Intellectual Property Office (KIPO), the contents of which are herein incorporated by reference in their entirety.

BACKGROUND

1. Field

Example embodiments relate to a method of removing particles in an injector of a diesel engine, an apparatus for performing the same and a diesel engine including the apparatus. More particularly, example embodiments relate to a method of removing particles accumulated on an inner wall of a low-pressure passage configured to receive a control valve of an injector, an apparatus for performing the method and a diesel engine including the apparatus.

2. Description of the Related Art

Generally, an injector of a diesel engine may inject a fuel into a combustion chamber using a pressure difference between an upper end and a lower end in a needle by a control valve. The needle may be arranged in a high-pressure passage in the injector. The control valve may be arranged in a low-pressure passage in the injector.

According to related arts, particles caused by a degeneration of the fuel may be continuously stagnated between the control valve and the low-pressure passage. The particles may be accumulated on an inner wall of the low-pressure passage to generate a malfunction of the control valve.

SUMMARY

Example embodiments provide a method of removing particles in an injector of a diesel engine that may be capable of effectively removing the particles accumulated in a low-pressure passage.

Example embodiments also provide an apparatus for performing the above-mentioned method.

Example embodiments still also provide a diesel engine including the above-mentioned apparatus.

According to example embodiments, there may be provided a method of removing particles in an injector of a diesel engine. In the method of removing the particles in the injector of the diesel engine, a stop of the diesel engine may be recognized. An injection signal may be inputted into the injector of the stopped diesel engine. A control valve of the injector may be moved in a low-pressure passage by the injection signal to remove the particles accumulated on an inner wall of the low-pressure passage.

In example embodiments, the method may further include checking a non-input of a cranking signal to the diesel engine from a stop point of the diesel engine to a set time.

In example embodiments, inputting the injection signal to the injector may include inputting the injection signal to the injector for a set time by a set period.

In example embodiments, inputting the injection signal to the injector may include inputting the injection signal to a plurality of the injectors in cylinders of the diesel engine.

In example embodiments, the method may further include stopping the removal of the particles in the injector of the diesel engine when a cranking signal may be checked in removing the particles.

According to example embodiments, there may be provided an apparatus for removing particles in an injector of a diesel engine. The apparatus may include a controller and a control valve. The controller may recognize a stop of the diesel engine. The controller may input an injection signal into the injector of the stopped diesel engine. The control valve may be moved in a low-pressure passage of the injector by the injection signal to remove the particles accumulated on an inner wall of the low-pressure passage.

In example embodiments, the controller may further check a non-input of a cranking signal to the diesel engine from a stop point of the diesel engine to a set time.

In example embodiments, the controller may input the injection signal to the injector for a set time by a set period.

In example embodiments, the controller may input the injection signal to a plurality of the injectors in cylinders of the diesel engine.

In example embodiments, the controller may further stop the removal of the particles in the injector of the diesel engine when a cranking signal may be checked in removing the particles.

According to example embodiments, there may be provided a diesel engine. The diesel engine may include a controller and a particle-removing apparatus. The controller may check a stop of the diesel engine. The controller may input an injection signal into the injector of the stopped diesel engine. The particle-removing apparatus may include a control valve. The control valve may be moved in a low-pressure passage of the injector by the injection signal to remove the particles accumulated on an inner wall of the low-pressure passage.

According to example embodiments, when the diesel engine may be stopped, a gap between the control valve and the low-pressure passage may be narrower than a gap when the diesel engine may be operated. When the injection signal may be inputted to the injector, the control valve may be moved in the low-pressure passage to remove the particles accumulated on the inner wall of the low-pressure passage. Thus, a malfunction of the control valve caused by the particles may be previously prevented.

BRIEF DESCRIPTION OF THE DRAWINGS

Example embodiments will be more clearly understood from the following detailed description taken in conjunction with the accompanying drawings.

FIG. 1 is a cross-sectional view illustrating an injector of a diesel engine with a particle-removing apparatus in accordance with example embodiments;

FIGS. 2 and 3 are cross-sectional views illustrating operations of the particle-removing apparatus in FIG. 1; and FIG. 4 is a flow chart illustrating a method of removing particles in the injector using the apparatus in FIG. 1.

DETAILED DESCRIPTION OF THE EMBODIMENTS

Figure 1:
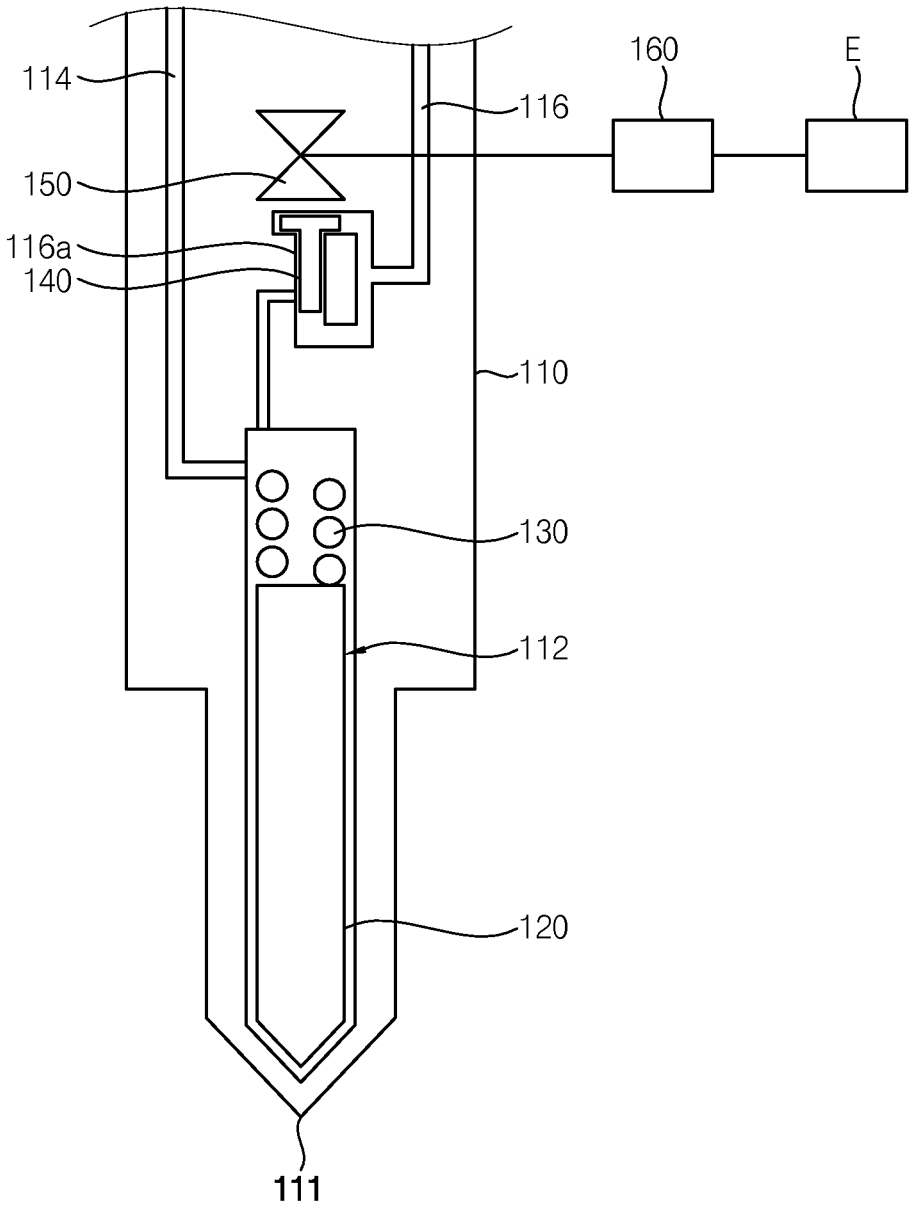
FIGS. 1 to 4 represent non-limiting, example embodiments as described herein.

Various example embodiments will be described more fully hereinafter with reference to the accompanying drawings, in which some example embodiments are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments will be explained in detail with reference to the accompanying drawings.

Figure 2:
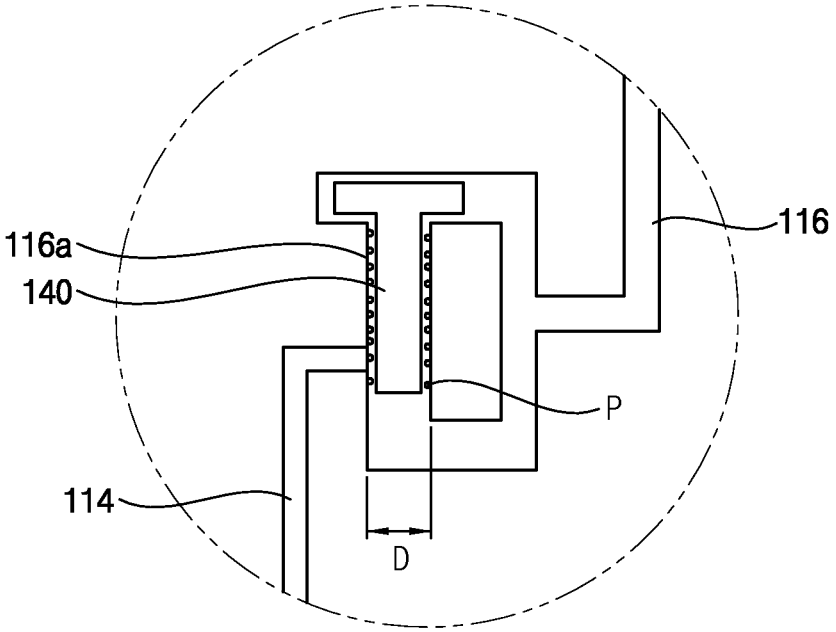
Figure 3:
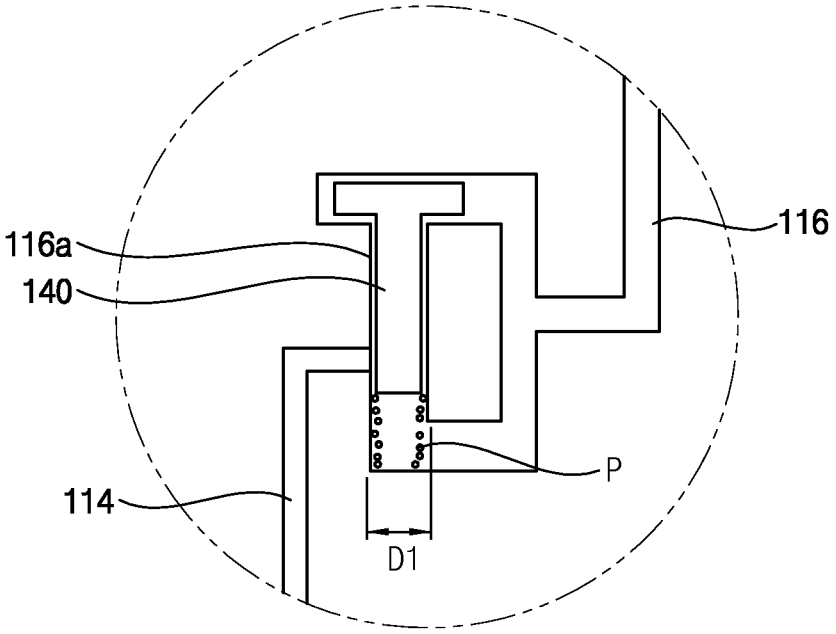

FIG. 1 is a cross-sectional view illustrating an injector of a diesel engine with a particle-removing apparatus in accordance with example embodiments and FIGS. 2 and 3 are cross-sectional views illustrating operations of the particle-removing apparatus in FIG. 1.

Referring to FIG. 1, an injector of a diesel engine E may include an injector body 110, a needle 120, a spring 130, a control valve 140 and an electromagnet solenoid 150.

The injector body 110 may include a fuel chamber 112, an injecting hole 111, a high-pressure passage 114 and a low-pressure passage 116. The fuel chamber 112 may be formed in the injector body 110 to receive a fuel. The injecting hole 111 may be extended from the fuel chamber 112. The injecting hole 111 may be formed through a lower end of the injector body 110 oriented toward a combustion chamber. The fuel in the fuel chamber 112 may be injected to the combustion chamber through the injecting hole 111. The high-pressure passage 114 may be connected to an upper portion of a side surface of the fuel chamber 112. The low-pressure passage 116 may be connected to an upper surface of the fuel chamber 112.

The needle 120 may be movably received in the fuel chamber 112 along a vertical direction. The needle 120 may be moved in the vertical direction by a pressure difference between an upper space and a lower space in the fuel chamber 112 to selectively open and close the injecting hole 111.

The spring 130 may be arranged in the upper space of the fuel chamber 112 over the needle 120 to resiliently support the needle in a downward direction, i.e., toward the injecting hole 111. When a pressure of the fuel supplied through the high-pressure passage 114 may be higher than a tensile force of the spring 130, the needle 120 may be upwardly moved with compression of the spring 130 so that the injecting hole 111 may be opened.

The control valve 140 may be movably arranged in the low-pressure passage 116 in the vertical direction. The control valve 140 may control flows of the fuel from the high-pressure passage 114 to the low-pressure passage 116 by a control of the electromagnet solenoid 150. When the electromagnet solenoid 150 may receive an injection signal, the control valve 140 blocking the low-pressure passage 116 may be upwardly moved so that the low-pressure passage 116 may be opened. That is, the pressure difference may be generated between the upper space and the lower space in the fuel chamber 112 centering around the needle 120. Thus, the fuel in the fuel chamber 112 may flow through the low-pressure passage 116 so that the needle 120 may be upwardly moved with the compression of the spring 130. As a result, the injecting hole 111 may be opened to inject the fuel into the combustion chamber through the injecting hole 111. The control valve 140 may be continuously moved in the low-pressure passage 116 along the vertical direction during the diesel engine E may be operated.

Referring to FIGS. 2 and 3, during the diesel engine E may be operated, a degenerated fuel and/or particles P may be accumulated on an inner wall 116*a* of the low-pressure passage 116. During the diesel engine E may be stopped, a gap D between the control valve 140 and the low-pressure passage 116 may be uniformly maintained. In contrast, during the diesel engine E may be operated, a gap D1 between the control valve 140 and the low-pressure passage 116 may be wider than the gap D due to the fuel having a high pressure in the injector.

Therefore, during the diesel engine E may be operated, the continuously moved control valve 140 may not remove the particles accumulated on the inner wall 116*a* of the low-pressure passage 116 due to the wide gap D1. As a result, the particles P may be continuously accumulated on the inner wall 116*a* of the low-pressure passage 116 to hinder the vertical movement of the control valve 140.

In order to prevent the above-mentioned problem, a particle-removing apparatus may be provided to the injector. The particle-removing apparatus may include a controller 160 and the control valve 140.

The controller 160 may recognize the stop of the diesel engine E. Further, the controller 160 may check an input of a cranking signal into the diesel engine E from a stop point of the diesel engine E to a set point.

When the cranking signal may not be inputted into the diesel engine E from the stop point to the set point, the controller 160 may transmit an injection signal to the injector. The controller 160 may input the injection signal into the injectors of cylinders in the diesel engine E. Particularly, the controller 160 may input the injection signal into the injector for a set time by a set period.

The electromagnet solenoid of the injector may operate the control valve 140 by the injection signal of the controller 160. As mentioned above, during the diesel engine E may be stopped, because the gap D between the control valve 140 and the low-pressure passage 116 may be narrower than the gap D1, the control valve 140 may be vertically moved in the low-pressure passage 116 to remove the particles P on the inner wall 116*a* of the low-pressure passage 116. Particularly, the removal of the particles P may be performed by the control valve 140 of the injector without using an additional part.

In contrast, when the cranking signal may be inputted into the diesel engine E during the stop point of the diesel engine E to the set time, the controller 160 may not transmit the injection signal to the injector. Thus, the controller 160 may not input the injection signal into the injectors of the cylinders in the diesel engine E to stop the removal of the particles P.

Figure 4:
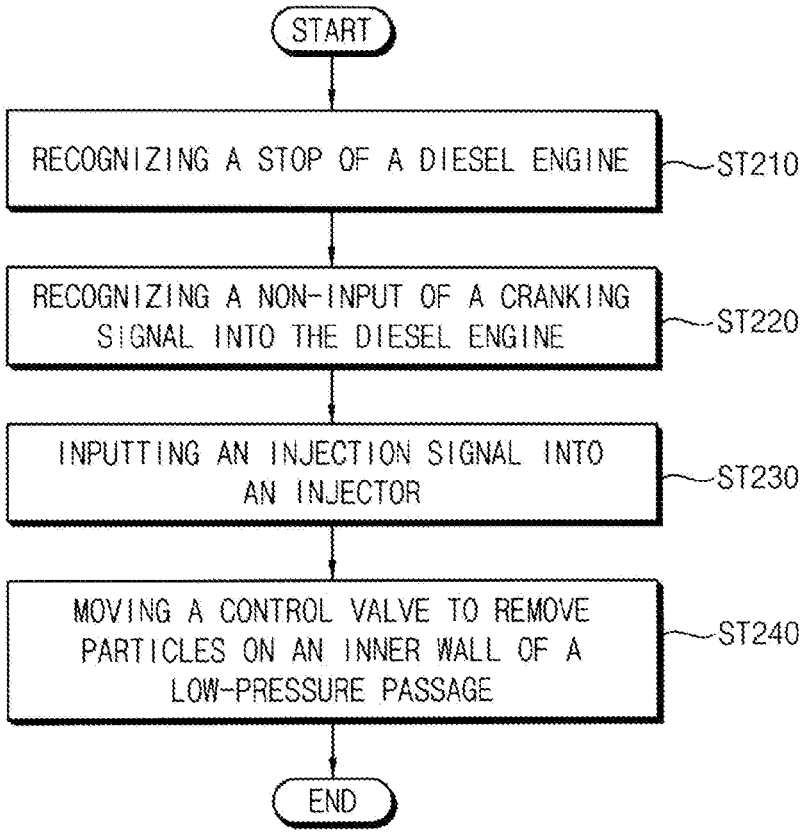

FIG. 4 is a flow chart illustrating a method of removing particles in the injector using the apparatus in FIG. 1.

Referring to FIGS. 1 to 5, in step ST210, the controller 160 may recognize the stop of the diesel engine E. For example, the controller 160 may recognize an off of an ignition key of the diesel engine E to recognize the stop of the diesel engine E.

In step ST220, the controller 160 may check the input of the cranking signal into the diesel engine E from the stop point of the diesel engine E to the set point. The set time may be determined by a user in accordance with kinds, conditions, etc., of the diesel engine E.

When the cranking signal may not be inputted into the diesel engine E from the stop point to the set point, in step ST230, the controller 160 may transmit the injection signal to the injector. The controller 160 may input the injection signal into the injectors of the cylinders in the diesel engine E. Particularly, the controller 160 may input the injection signal into the injector for the set time by the set period.

In step ST240, the electromagnet solenoid of the injector may operate the control valve 140 by the injection signal of the controller 160. During the diesel engine E may be stopped, because the gap D between the control valve 140 and the low-pressure passage 116 may be narrower than the gap D1, an outer surface of the control valve 140 may be positioned adjacent to the inner wall 116*a* of the low-pressure passage 116. Thus, the control valve 140 may be vertically moved in the low-pressure passage 116 to remove the particles P on the inner wall 116*a* of the low-pressure passage 116. Particularly, the removal of the particles P may be performed by the control valve 140 of the injector without using an additional part.

In contrast, when the cranking signal may be inputted into the diesel engine E during the stop point of the diesel engine E to the set time, the controller 160 may not transmit the injection signal to the injector. Thus, the controller 160 may not input the injection signal into the injectors of the cylinders in the diesel engine E to stop the removal of the particles P.

According to example embodiments, when the diesel engine may be stopped, a gap between the control valve and the low-pressure passage may be narrower than a gap when the diesel engine may be operated. When the injection signal may be inputted to the injector, the control valve may be moved in the low-pressure passage to remove the particles accumulated on the inner wall of the low-pressure passage. Thus, a malfunction of the control valve caused by the particles may be previously prevented.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of removing particles in an injector of a diesel engine, the method comprising:

recognizing a stop of the diesel engine;

inputting an injection signal to the injector of the stopped diesel engine; and moving, while the diesel engine is stopped, a control valve of the injector in a low-pressure passage of the injector by the injection signal, wherein the control valve is movably arranged in the low-pressure passage for controlling a flow of a fuel from a high-pressure passage of the injector to the low-pressure passage, and an outer surface of the control valve is positioned adjacent to an inner wall disposed within the low-pressure passage and moves along the inner wall of the low-pressure passage to remove particles accumulated on the inner wall of the low-pressure passage.

2. The method of claim 1, further comprising recognizing a non-input of a cranking signal to the diesel engine from the stop of the diesel engine to a set time.

3. The method of claim 1, wherein inputting the injection signal to the injector comprises inputting the injection signal to the injector for a set time by a set period.

4. The method of claim 3, wherein inputting the injection signal to the injector further comprises inputting the injection signal to a plurality of injectors of a plurality of cylinders in the diesel engine.

5. The method of claim 1, further comprising: in response to a cranking signal being subsequently input to the diesel engine while particles are being removed, stopping the injection signal to the injector.

6. An apparatus for removing particles in an injector of a diesel engine, the apparatus comprising:

a controller configured to recognize a stop of the diesel engine and to input an injection signal to the injector of the stopped diesel engine; and a control valve configured to move, while the diesel engine is stopped, in a low-pressure passage of the injector by the injection signal, wherein the control valve is movably arranged in the low-pressure passage for controlling a flow of a fuel from a high-pressure passage of the injector to the low-pressure passage, and an outer surface of the control valve is positioned adjacent to an inner wall disposed within the low-pressure passage and configured to move along the inner wall of the low-pressure passage to remove particles accumulated on the inner wall of the low-pressure passage.

7. The apparatus of claim 6, wherein the controller is configured to recognize a non-input of a cranking signal to the diesel engine from the stop of the diesel engine to a set time.

8. The apparatus of claim 6, wherein the controller is configured to input the injection signal to the injector for a set time by a set period.

9. The apparatus of claim 6, wherein the controller is configured to input the injection signal to a plurality of injectors of a plurality of cylinders in the diesel engine.

10. The apparatus of claim 6, wherein the controller is configured to, in response to a cranking signal being subsequently input to the diesel engine while particles are being removed, stop the injection signal to the injector.

11. A diesel engine comprising:

a controller configured to recognize a stop of the diesel engine and to input an injection signal to an injector of the stopped diesel engine; and a particle-removing apparatus including a control valve, the control valve being configured to move, while the diesel engine is stopped, in a low-pressure passage of the injector by the injection signal, wherein the control valve is movably arranged in the low-pressure passage for controlling a flow of a fuel from a high-pressure passage of the injector to the low-pressure passage, and an outer surface of the control valve is positioned adjacent to an inner wall disposed within the low-pressure passage and moves along the inner wall of the low-pressure passage to remove particles accumulated on the inner wall of the low-pressure passage.

* * * * *